US011002273B2

(12) United States Patent
Choi et al.

(10) Patent No.: US 11,002,273 B2
(45) Date of Patent: May 11, 2021

(54) COMPRESSOR HAVING ENHANCED WRAP STRUCTURE

(71) Applicant: LG Electronics Inc., Seoul (KR)

(72) Inventors: Jungsun Choi, Seoul (KR); Sang Baek Park, Seoul (KR); Cheol Hwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 77 days.

(21) Appl. No.: 16/409,186

(22) Filed: May 10, 2019

(65) Prior Publication Data

US 2019/0345933 A1 Nov. 14, 2019

(30) Foreign Application Priority Data

May 10, 2018 (KR) ..... 10-2018-0053900

(51) Int. Cl.
*F04C 18/02* (2006.01)

(52) U.S. Cl.
CPC ..... *F04C 18/0215* (2013.01); *F04C 2240/20* (2013.01)

(58) Field of Classification Search
CPC ..... F04C 18/0207; F04C 18/0215; F04C 18/0269; F04C 18/0276; F04C 18/0284; F04C 2230/602
See application file for complete search history.

(56) References Cited

U.S. PATENT DOCUMENTS 5,318,424 A 7/1994 Bush et al.
6,142,755 A * 11/2000 Shiinoki ..... F04C 27/005 418/55.2
10,724,521 B2 * 7/2020 Choi ..... F04C 18/0215
2013/0302518 A1 * 11/2013 Asami ..... B05D 1/02 427/177
2015/0004040 A1 1/2015 Katon
2017/0306953 A1 * 10/2017 Choi ..... F01C 21/102
2017/0306954 A1 10/2017 Kim et al.
2017/0306955 A1 10/2017 Choi et al.

FOREIGN PATENT DOCUMENTS

EP 0601959 6/1994
EP 2759708 7/2014
EP 3239458 11/2017
EP 3239528 11/2017

OTHER PUBLICATIONS

EP Search Report in European Application No. EP19173738, dated Oct. 14, 2019, 9 pages.

* cited by examiner

*Primary Examiner* — Patrick Hamo
(74) *Attorney, Agent, or Firm* — Fish & Richardson P.C.

(57) ABSTRACT

A scroll compressor includes a casing; a drive motor; a rotary shaft; a fixed scroll including a fixed wrap; and an orbiting scroll eccentrically coupled to rotary shaft and including an orbiting wrap configured to engage with the fixed wrap. At least one of the fixed wrap or the orbiting wrap defines an offset section that is defined between the fixed wrap and the orbiting wrap and that is greater than an orbital radius corresponding to a distance between the fixed wrap and the orbiting wrap in a state in which a center of the fixed scroll is aligned to a center of the orbiting scroll. The offset section is disposed at a contact portion between the fixed wrap and the orbiting wrap. The contact portion has a maximum length based on a rotation angle of the rotary shaft being within a pre-set range with respect to a reference point.

20 Claims, 10 Drawing Sheets

200: 150,230,240,250,270

COMPRESSOR HAVING ENHANCED WRAP STRUCTURE

CROSS-REFERENCE TO RELATED APPLICATION

This application claims priority to and the benefit of Korean Patent Application No. 10-2018-0053900, filed on May 10, 2018, the disclosure of which is incorporated herein by reference in its entirety.

BACKGROUND

1. Field of the Invention

The present disclosure relates to a scroll compressor with an enhanced wrap structure that can minimize deformation done to an orbiting wrap or a fixed wrap by centrifugal force.

2. Description of Related Art

Generally, compressors are operated in a vapor compression type refrigeration cycle (hereinafter referred to as "a refrigeration cycle") that is used for a refrigerator or an air conditioner.

Compressors may be classified into reciprocating compressors, rotary compressors, scroll compressors, and the like on the basis of methods of compressing refrigerants.

A scroll compressor is a compressor in which an orbiting scroll is engaged with a fixed scroll that is fixed to inner space of an airtight container, and orbits to form a compression chamber between a fixed wrap of the fixed scroll and an orbiting wrap of the orbiting scroll.

Unlike other types of compressors, a scroll compressor has the advantages of obtaining a high compression ratio, smoothly performing the processes of suction, compression and discharge of refrigerants and obtaining stable torque. Accordingly, a scroll compressor has been widely used to compress refrigerants in an air conditioning device, and the like.

However, a scroll compressor has a problem. The problem is that when a scroll compressor operates, an orbiting scroll or a fixed scroll may be deformed and damaged due to thermal expansion or thermal pressure and may cause compression loss. A specific portion of a fixed wrap is thermally deformed more significantly than the other portions, and accordingly, the fixed wrap contacts an orbiting wrap. Thus, friction loss between the fixed scroll and the orbiting scroll may occur, and wear of the fixed scroll and the orbiting scroll increases.

In Korean Patent No. 10-2017-0122016A, a conventional scroll compressor is disclosed. With reference to the disclosure, the conventional scroll compressor is described.

FIG. 1 is a plan view illustrating a conventional scroll compressor in which a fixed scroll and an orbiting scroll that include an offset part respectively are coupled in a state where the center of the fixed scroll is aligned to the center of the orbiting scroll, and FIG. 2 is an enlarged plan view illustrating the offset part in FIG. 1.

FIGS. 1 and 2 are illustrated in Korean Patent No. 10-2017-0122016A, and reference numerals in FIGS. 1 and 2 are used only in the drawings.

Referring to FIGS. 1 and 2, in the case of a conventional scroll compressor, the offset part (Os) that is dented to a certain depth on a lateral surface of the fixed wrap 323 or the orbiting wrap 332 is formed in a section that constitutes an intake chamber.

Accordingly, specific portions (i.e., a section that constitutes an intake chamber) of the fixed wrap 323 and the orbiting wrap 332 may be prevented from being thermally deformed. By doing so, the specific portions of the fixed wrap 323 and the orbiting wrap 332 may be prevented from being excessively contacted, thereby making it possible to reduce friction loss and wear.

The conventional scroll compressor may solve the problem of thermal deformation. However, in the conventional scroll compressor, the orbiting wrap 332 or the fixed wrap 323 is vulnerable to deformation or damage that is caused by centrifugal force.

In the conventional scroll compressor, the orbiting scroll, as described above, is engaged with the fixed scroll and orbits. Accordingly, centrifugal force is applied to the orbiting wrap 332 and the fixed wrap 323 due to an orbital movement.

In the case in which there are a small number of points of contact between the orbiting wrap 332 and the fixed wrap 323, during a high-speed orbital movement, centrifugal force concentrates on a portion in which a surface area of contact between the orbiting wrap 332 and the fixed wrap 323 is large. Thus, the wraps are highly likely to be deformed or damaged. When the contact surface area is large and wrap thickness is small, the wraps are easily deformed and damaged due to centrifugal force. Further, when a part of the orbiting wrap 332 or the fixed wrap 323 is deformed or damaged due to centrifugal force, efficiency and credibility of the scroll compressor may be undermined.

SUMMARY OF THE INVENTION

One aspect of the present disclosure is to provide a scroll compressor that can minimize deformation or damage done to wraps by centrifugal force.

Another aspect of the present disclosure is to provide a scroll compressor that can improve efficiency of offset processing.

Objectives of the present disclosure are not limited to what has been described. Additionally, other objectives and advantages that have not been mentioned may be understood from the following description and may be more clearly understood from embodiments. Further, it will be understood that the objectives and advantages of the present disclosure may be realized via means and a combination thereof that are described in the appended claims.

The present disclosure describes a scroll compressor in which an offset section is formed in a section where a surface area of contact between a fixed wrap and an orbiting wrap is largest when a crank angle is within a pre-set range of angles with respect to a suction ending point so as to minimize deformation or damage done to the wraps by centrifugal force.

The present disclosure describes a scroll compressor in which an offset part is formed in a section (i.e., an offset section) of wraps, which is most vulnerable to deformation or damage caused by centrifugal force, so as to improve efficiency of offset processing.

The scroll compressor according to the present disclosure may minimize deformation or damage done to wraps by centrifugal force, thereby making it possible to improve efficiency and credibility of the scroll compressor.

In the scroll compressor according to the present disclosure, a section (i.e., an offset section) of wraps, which is most vulnerable to deformation or damage caused by centrifugal force is selected based on the number of points of contact between an orbiting wrap and a fixed wrap and surface areas of contact between the orbiting wrap and the fixed wrap, and an offset part is formed only in the section, thereby making it possible to improve efficiency of offset processing. That is, the offset part is not formed in sections that are not in priority, thereby making it possible to prevent an increase in manufacturing time and manufacturing cost due to offset processing.

Specific effects of the present disclosure together with the above-described effects are described in the following detailed description of the disclosure.

DETAILED DESCRIPTION OF EXEMPLARY EMBODIMENT

Figure 1:
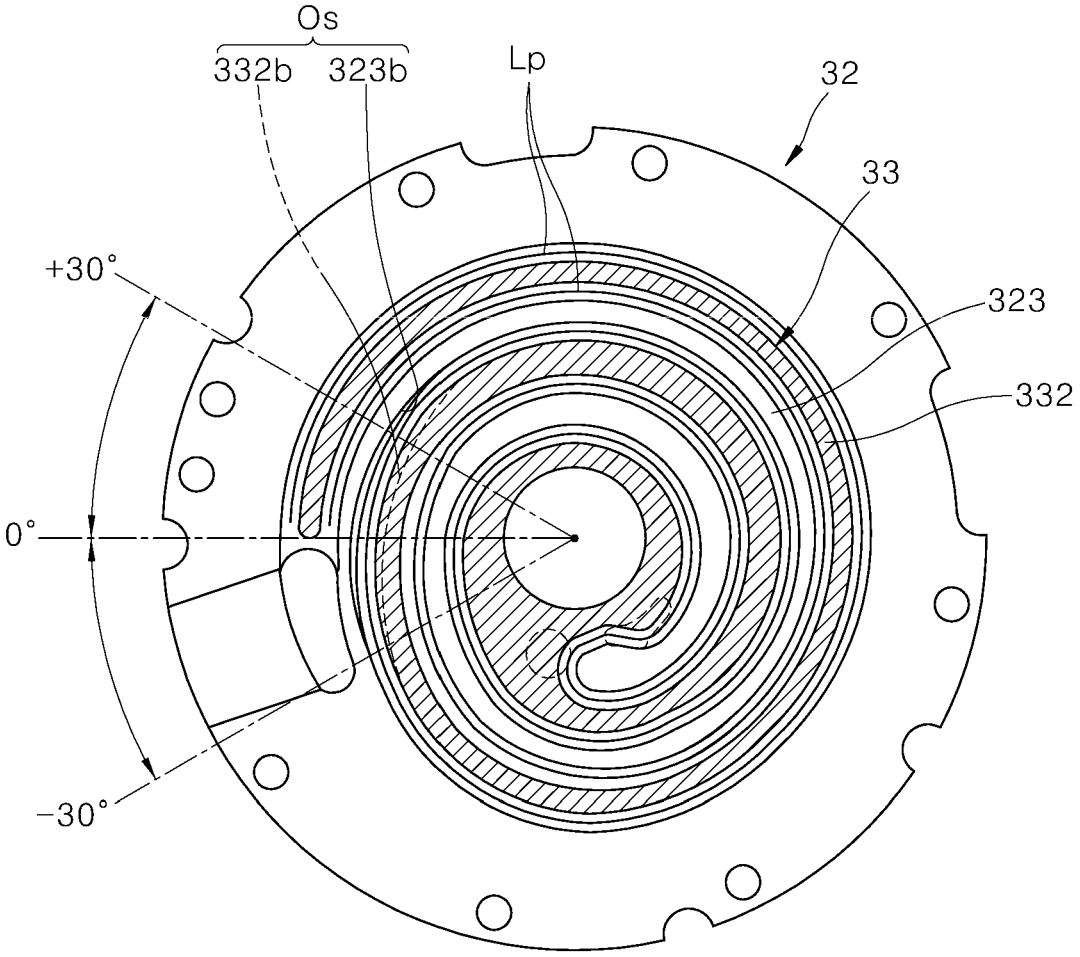
FIG. 1 is a plan view illustrating a conventional scroll compressor in which a fixed scroll and an orbiting scroll that include an offset part respectively are coupled in a state where the center of the fixed scroll is aligned to the center of the orbiting scroll.
Figure 2:
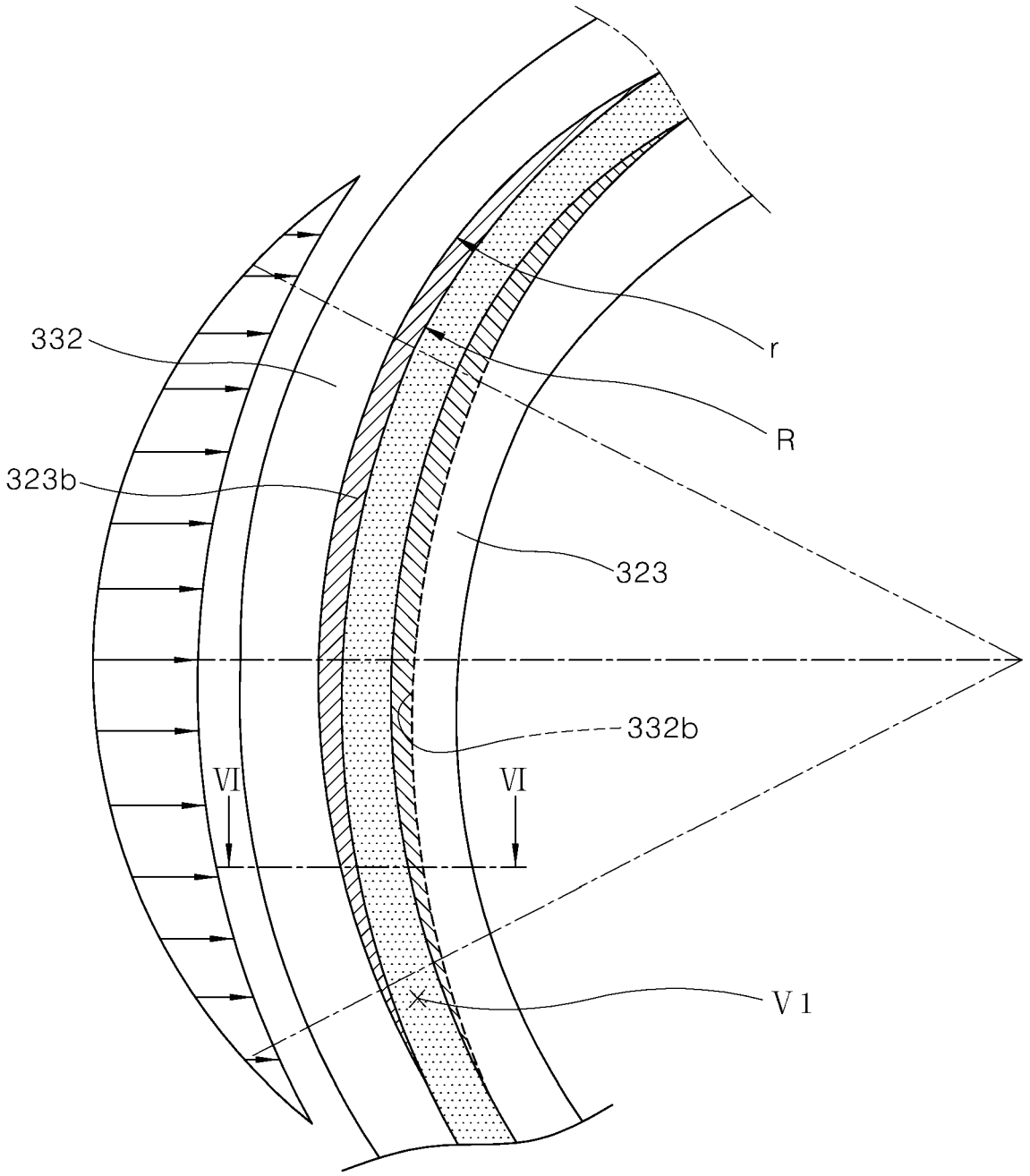
FIG. 2 is an enlarged plan view illustrating the offset part in FIG. 1.

Below, implementations of the present disclosure are described with reference to the attached drawings. Like reference numerals denote like elements or similar elements in the drawings.

Figure 3:
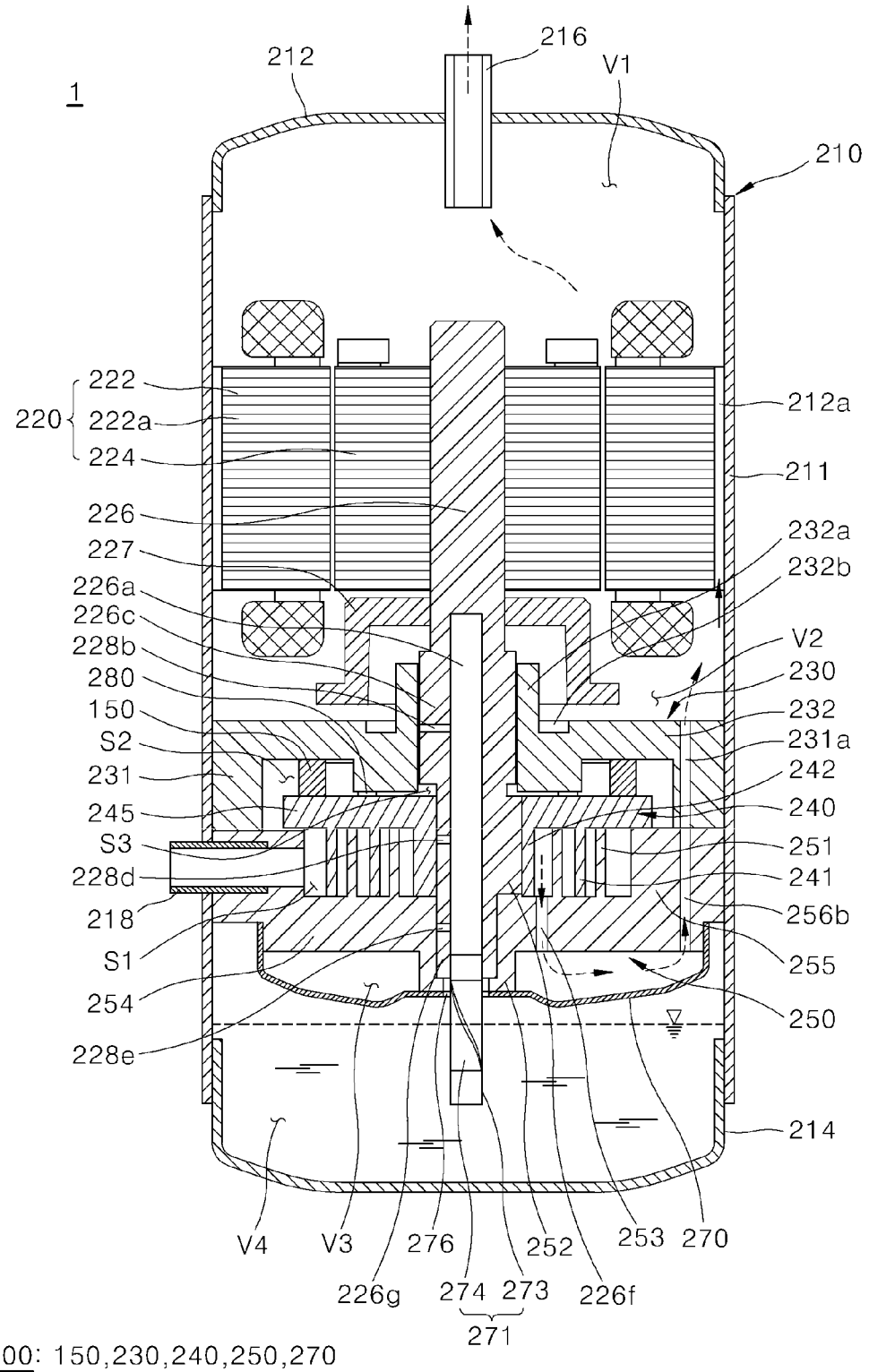
FIG. 3 is a sectional view illustrating an example scroll compressor.

With reference to FIG. 3, an example scroll compressor is described.

FIG. 3 is a sectional view illustrating an example scroll compressor.

The scroll compressor 1 may include a casing 210 that has inner space, a drive motor 220 that is provided in an upper portion of the inner space, a compressor 200 that is disposed in a lower portion of the drive motor 220, and a rotary shaft 226 that delivers driving force of the drive motor 220 to the compressor 200.

The inner space of the casing 210 may be divided into first space (V1) that is an upper side of the drive motor 220, second space (V2) that is between the drive motor 220 and the compressor 200, third space (V3) that is partitioned by a discharge cover 270, and oil storage space (V4) that is a lower side of the compressor 200.

The casing 210, for instance, may have the shape of a cylinder and, accordingly, may include a cylindrical shell 211.

Additionally, the cylindrical shell 211 may include an upper shell 212 in an upper portion thereof and may include a lower shell 214 in a lower portion thereof. The upper and lower shells 212, 214, for instance, may be welded to the cylindrical shell 211 so as to form inner space.

The upper shell 212 may include a refrigerant discharge pipe 216. The refrigerant discharge pipe 216 is a passage for discharging compressed refrigerants, which is discharged from the compressor 200 to the first space (V1) and the second space (V2), to the outside.

The refrigerant discharge pipe 216 may connect with an oil separator (invisible) that separates oil mixed in discharged refrigerants from the discharged refrigerants. The lower shell 214 may form oil storage space (V4) that may store oil.

The oil storage space (V4) may perform a function of an oil chamber that supplies oil to the compressor 200 so that the compressor may operate smoothly Additionally, the cylindrical shell 211 may include a refrigerant suction pipe 218 that is a passage for introducing refrigerants to be compressed on a lateral surface of the cylindrical shell 211.

The refrigerant suction pipe 218 may be installed to penetrate the compression chamber (S1) along a lateral surface of a fixed scroll 250.

The drive motor 220 may be installed in an inner upper portion of the casing 210.

Specifically, the drive motor 220 may include a stator 222 and a rotor 224.

The stator 222, for instance, may have the shape of a cylinder and may be fixed to the casing 210. The stator 222 has a plurality of slots (invisible) on an inner circumferential surface of the stator in a circumferential direction, and a coil 222*a* is wound around the stator. Additionally, the stator 222 may have a refrigerant flow path groove 212*a* that is cut in the shape of a D-cut and that allows refrigerants or oil discharged from the compressor 200 to pass through on an outer circumferential surface of the stator.

The rotor 224 is coupled to the inside of the stator 222 and may generate rotational power. Additionally, the rotary shaft 226 is press-fitted into a center of the rotor 224 to rotate together with the rotor 224. Rotational power that is generated by the rotor 224 is delivered to the compressor 200 through the rotary shaft 226.

The compressor 200 may include an Oldham's ring 150, a main frame 230, a fixed scroll 250, an orbiting scroll 240, and a discharge cover 270.

The Oldham's ring 150 may be installed between the main frame 230 and the orbiting scroll 240. The Oldham's ring 150 is coupled respectively to the main frame 230 and the orbiting scroll 240 to prevent the orbiting scroll 240 from spinning.

The main frame 230 is provided in a lower portion of the drive motor 220 and may form an upper portion of the compressor 200.

The main frame 230 may include a frame end plate (hereinafter referred to as "first end plate) 232 that has the shape of an approximate circle, a frame bearing section (hereinafter referred to as "first bearing section) 232*a* which is provided at a center of the first end plate 232 and through which the rotary shaft 226 passes, and a frame side wall (hereinafter referred to as "first side wall") 231 that protrudes from an outer circumference of the first end plate 232 to a lower portion thereof.

An outer circumference of the first side wall 231 may contact an inner circumferential surface of the cylindrical shell 211 while a lower end of the first side wall 231 may contact an upper end of a below-described fixed scroll side wall 255.

The first side wall 231 may include a frame discharge hole (hereinafter referred to as "first discharge hole") 231*a* that axially passes through the first side wall 231 and constitutes a passage for refrigerants. An inlet of the first discharge hole 231*a* may connect with an outlet of a below-described fixed scroll discharge hole 256*b* while an outlet of the first discharge hole 231*a* may connect to the second space (V2).

The first bearing section 232*a* may protrude from an upper surface of the first end plate 232 toward the drive motor 220. Additionally, the first bearing section 232*a* may include a first bearing such that a main bearing 226*c* of a below-described rotary shaft 226 penetrates and is supported.

That is, the first bearing section 232*a* where the main bearing 226*c* of the rotary shaft 226 that constitutes the first bearing is rotatably inserted and supported may be formed to axially penetrate the center of the main frame 230.

The first end plate 232 may have an oil pocket 232*b* that collects oil discharged from between the first bearing section 232*a* and the rotary shaft 226 on an upper surface of the first end plate 232.

Specifically, the oil pocket 232*b* may be concavely formed on the upper surface of the first end plate 232 and may be formed along an outer circumferential surface of the first bearing section 232*a* in the shape of a ring.

Additionally, a back pressure chamber (S2) that forms space together with the fixed scroll 250 and the orbiting scroll 240 may be formed on a bottom surface of the main frame 230 such that the orbiting scroll 240 is supported by means of pressure on the space.

The back pressure chamber (S2) may be an intermediate pressure section (i.e., intermediate pressure chamber), and an oil supply flow path 226*a* that is provided in the rotary shaft 226 may have higher pressure than the back pressure chamber (S2). Additionally, space surrounded by the rotary shaft 226, the main frame 230 and the orbiting scroll 240 may be a high-pressure area (S3).

A back pressure seal 280 may be provided between the main frame 230 and the orbiting scroll 240 to separate the high-pressure area (S3) and the back pressure chamber (S2; i.e., an intermediate pressure area). The back pressure seal 280, for instance, may function as a sealing member.

The main frame 230 may be coupled to the fixed scroll 250 to form space in which the orbiting scroll 240 may be orbitably installed. In this structure, the rotary shaft 226 is encircled such that rotational power is delivered to the compressor 200 through the rotary shaft 226.

A fixed scroll 250 that constitutes a first scroll may be coupled to a bottom surface of the main frame 230.

Specifically, the fixed scroll 250 may be provided in a lower portion of the main frame 230.

Additionally, the fixed scroll 250 may include a fixed scroll end plate (second end plate) 254 that has the shape of an approximate circle, a fixed scroll side wall (hereinafter referred to as "second side wall) 255 that protrudes from an outer circumference of the second end plate 254 toward an upper portion thereof, a fixed wrap 251 that protrudes from an upper surface of the second end plate 254 and that is engaged with an orbiting wrap 241 of a below-described orbiting scroll 240 to form a compression chamber (S1) consisting of an intake chamber, an intermediate-pressure chamber and a discharge chamber, and a fixed scroll bearing section (hereinafter referred to as "second bearing section") 252 which is formed at a center of a rear surface of the second end plate 254 and through which the rotary shaft 226 passes.

The second end plate 254 may include a discharge path 253 that guides compressed refrigerants from the compression chamber (S1) into the discharge cover 270. The discharge path 253 may be installed in any portion considering required discharge pressure, and the like.

The discharge path 253 is formed toward the lower shell 214. Accordingly, the discharge cover 270 that accommodates discharged refrigerants and that guides the discharged refrigerants into a below-described fixed scroll discharge hole 256*b* to prevent the discharged refrigerants from being mixed with oil may be coupled to the bottom surface of the fixed scroll 250. The discharge cover 270 may be seal-coupled to a bottom surface of the fixed scroll 250 to separate a refrigerant discharge flow path and the oil storage space (V4).

Additionally, the discharge cover 270 may have a through-hole 276 to allow an oil feeder 271 that is coupled to a sub bearing 226*g* of the rotary shaft 226 constituting a second bearing and that is submerged in the oil storage space (V4) of the casing 210 to pass through.

An outer circumference of the second side wall 255 may contact an inner circumferential surface of the cylindrical shell 211, and an upper end of the second side wall 255 may contact a lower end of the first side wall 231.

Additionally, the second side wall 255 may include a fixed scroll discharge hole (hereinafter referred to as "second discharge hole) 256*b* that axially penetrates the second side wall 255 and that constitutes a passage for refrigerants together with the first discharge hole 231*a*.

The second discharge hole 256*b* may be formed to correspond to the first discharge hole 231*a*, and an inlet of the second discharge hole 256*b* may connect to inner space of the discharge cover 270 while an outlet of the second discharge hole 256*b* may connect to the inlet of the first discharge hole 231*a*.

The first discharge hole 231*a* and the second discharge hole 256*b* may connect the second space (V2) and the third space (V3) such that refrigerants discharged from the compression chamber (S1) to inner space of the discharge cover 270 is guided into the second space (V2).

The refrigerant suction pipe 218 may be installed on the second side wall 255 to connect to a suction part of the compression chamber (S1) and may be spaced apart from the second discharge hole 256*b*.

The second bearing section 252 may protrude from a lower surface of the second end plate 254 toward the oil storage space (V4).

Additionally, the second bearing section 252 may include a second bearing such that a below-described sub bearing 226*g* of the rotary shaft 226 is inserted and supported.

A lower end of the second bearing section 252 may be bent toward the center of the rotary shaft to support a lower end of the sub bearing 226*g* of the rotary shaft 226 and to constitute a thrust bearing surface.

The orbiting scroll 240 that constitutes a second scroll may be installed between the main frame 230 and the fixed scroll 250.

A pair of compression chambers (S1) may be formed between the orbiting scroll 240 and the fixed scroll 250 while the orbiting scroll 240 connects to the rotary shaft 226 and orbits.

The orbiting scroll 240 may include an orbiting scroll end plate (hereinafter referred to as "third end plate) 245 that has the shape of an approximate circle, an orbiting wrap 241 that protrudes from a lower surface of the third end plate 245 and that is engaged with a fixed wrap 251, and a rotary shaft coupler 242 that is provided at a center of the third end plate 245 and that is rotatably coupled to a below-described eccentric portion 226*f* of the rotary shaft 226.

In the case of the orbiting scroll 240, an outer circumference the third end plate 245 may be positioned at an upper end of the second side wall 255, and a lower end of the orbiting wrap 241 may closely contact an upper surface of the second end plate 254, to be supported by the fixed scroll 250.

An outer circumference of the rotary shaft coupler 242 connects with the orbiting wrap 241 to form the compression chamber (S1) together with the fixed wrap 251 in the process of compression.

The fixed wrap 251 and the orbiting wrap 241 may have the shape of an involute, but the shapes of the fixed wrap and the orbiting wrap are not restricted.

The involute denotes a curve that is a path taken by the end of a string wound around a basic circle with any radius when the string is unwound.

When a distance between the fixed wrap 251 and the orbiting wrap 241 is referred to as an orbital radius in the state in which the center of the fixed scroll 250 is aligned to the center of the orbiting scroll 240, an offset section that has a gap greater than the orbital radius may be formed between a lateral surface of the fixed wrap 251 and a lateral surface of the orbiting wrap 241, which faces the lateral surface of the fixed wrap. The offset section is formed in a section where a surface area of contact between the fixed wrap 251 and the orbiting wrap 241 is largest when the crank angle is within a pre-set range of angles with respect to the suction ending point. Detailed description in relation to this is described below.

An eccentric portion 226*f* of the rotary shaft 226 may be inserted into the rotary shaft coupler 242. The eccentric portion 226*f* that is inserted into the rotary shaft coupler 242 may be overlapped with the orbiting wrap 241 or the fixed wrap 251 in a radial direction of the compressor.

The radial direction may denote a direction (i.e., left-right direction) that is orthogonal to an axial direction (i.e., up-down direction) and specifically, may denote a direction from the outer side of the rotary shaft toward the inner side of the rotary shaft.

As described above, when the eccentric portion 226*f* of the rotary shaft 226 penetrates the end plate 245 of the orbiting scroll 240 and is overwrapped with the orbiting wrap 241 in the radial direction, a repulsive force and compressive force of the refrigerant are applied to the same flat surface with respect to the end plate 245. Accordingly, a certain degree of the repulsive force and compressive force may be offset.

The rotary shaft 226 may connect to the drive motor 220 and may be provided with an oil supply flow path 226*a* that guides oil stored in the oil storage space (V4) of the casing 210 upward.

Specifically, an upper portion of the rotary shaft 226 may be press-fitted into and coupled to the center of the rotor 224, and a lower portion of the rotary shaft may be coupled to the compressor 200 and be supported in the radial direction.

By doing so, the rotary shaft 226 may deliver the rotational force of the driving moth drive motor 220 to the orbiting scroll 240 of the compressor 200. Thus, the orbiting scroll 240 that is eccentrically coupled to the rotary shaft 226 may orbit with respect to the fixed scroll 250.

A main bearing 226*c* may be formed in a lower portion of the rotary shaft 226 to be inserted into the first bearing section 232*a* of the main frame 230 and supported by the first bearing section 232*a* of the main frame 230 in the radial direction. Additionally, a sub-bearing 226*g* may be formed in a lower portion of the main bearing 226*c* to be inserted into the second bearing section 252 of the fixed scroll 250 and supported by the second bearing section 252 of the fixed scroll 250 in the radial direction.

The eccentric portion 226*f* that is inserted into and coupled to the rotary shaft coupler 242 of the orbiting scroll 240 may be formed between the main bearing 226*c* and the sub bearing 226*g*.

The main bearing 226*c* and the sub bearing 226*g* may be formed on the same axis to have the same axial center. The eccentric portion 226*f* may be eccentrically positioned in the radial direction with respect to the main bearing 226*c* or the sub bearing 226*g*.

An outer diameter of the eccentric portion 226*f* may be smaller than that of the main bearing 226*c* and may be larger than that of the sub bearing 226*g*. By doing so, the rotary shaft 226 may readily pass through and may be readily coupled to each of the bearing sections 232*a*, 252 and the rotary shaft coupler 242.

The eccentric portion 226*f* may also be formed using an additional bearing without being integrally formed with the rotary shaft 226. In this case, although the outer diameter of the sub bearing 226*g* is not smaller than that of the eccentric portion 226*f*, the rotary shaft 226 may be inserted into and coupled to each of the bearing sections 232*a*, 252 and the rotary shaft coupler 242.

The oil supply flow path 226*a* that supplies oil in the oil storage space (V4) to an outer circumferential surface of each of the bearings 226*c*, 226*g* and an outer circumferential surface of the eccentric portion 226*f* may be formed in the rotary shaft 226. Additionally, an oil hole 228*b*, 228*d*, 228*e* that penetrates from the oil supply flow path 226*a* to an outer circumferential surface of the bearing and the eccentric portion 226*c*, 226*g*, 226*f* may be formed in the bearing and the eccentric portion 226*c*, 226*g*, 226*f* of the rotary shaft 226.

Oil that is guided upward by the oil supply flow path 226*a* may be discharged through the oil hole 228*b*, 228*d*, 228*e* and may be supplied to a bearing surface, and the like.

An oil feeder 271 that pumps oil filling the oil storage space (V4) may be coupled to a lower end of the rotary shaft 226, i.e., a lower end of the sub bearing 226*g*.

The oil feeder 271 may consist of an oil supply pipe 273 that is inserted into and coupled to the oil supply flow path 226*a* of the rotary shaft 226, and an oil suction member 274 that is inserted into the oil supply pipe 273 and suctions oil.

The oil supply pipe 273 may be installed to penetrate a through-hole 276 of the discharge cover 270 and to sink into the oil storage space (V4), and the oil suction member 274 may function as a propeller.

Though not illustrated in the drawings, instead of the oil feeder 271, a trochoid pump (invisible) may be coupled to the sub bearing 226*g* to forcibly pump oil filling the oil storage space (V4) upward.

Though not illustrated in the drawings, an example scroll compressor may further include a first sealing member (invisible) that seals a gap between an upper end of the main baring part 226*c* and an upper end of the main frame 230, and a second sealing member (invisible) that seals a gap between a lower end of the sub bearing 226*g* and a lower end of the fixed scroll 250.

The first and second sealing members may prevent oil from leaking out of the compressor 200 along the bearing surface. By doing so, a structure of differential pressure oil feeding may be implemented and refrigerants are prevented from counter-current flow.

A balance weight 227 may be coupled to the rotor 224 or the rotary shaft 226 to contain noise oscillations.

The balance weight 227 may be placed between the drive motor 227 and the compressor 200, i.e., in the second space (V2).

Operation of an example scroll compressor 1 is described as follows.

When electric power is applied to a drive motor 220 and rotational force occurs, a rotary shaft that is couple to a rotor 224 of the drive motor 220 rotates. Then while an orbiting scroll 240 that is eccentrically coupled to the rotary shaft 226 orbits with respect to a fixed scroll 250, a compression chamber (S1) is formed between an orbiting wrap 241 and a fixed wrap 251. The compression chamber (S1) may be formed in several steps in succession as the volume of the compression chamber S1 gradually decreases toward the center direction of the rotary shaft.

Then refrigerants that are supplied from the outside of a casing 210 through a refrigerant suction pipe 218 may be directly introduced into the compression chamber (S1). The refrigerants may be compressed while moving to a discharge chamber of the compression chamber (S1) via an orbital movement of the orbiting scroll 240 and then, in the discharge chamber, may be discharged into third space (V3) through a discharge path 253 of the fixed scroll 250.

Next, a series of processes in which the compressed refrigerants that are discharged into the third space (V3) are discharged into inner space of the casing 210 through a first discharge hole 231*a* and a second discharge hole 256*b* and then is discharged out of the casing 210 through a refrigerant discharge pipe 216 are repeated.

Below, a wrap structure of the scroll compressor in FIG. 3 is described with reference to FIGS. 4 to 10.

Figure 4:
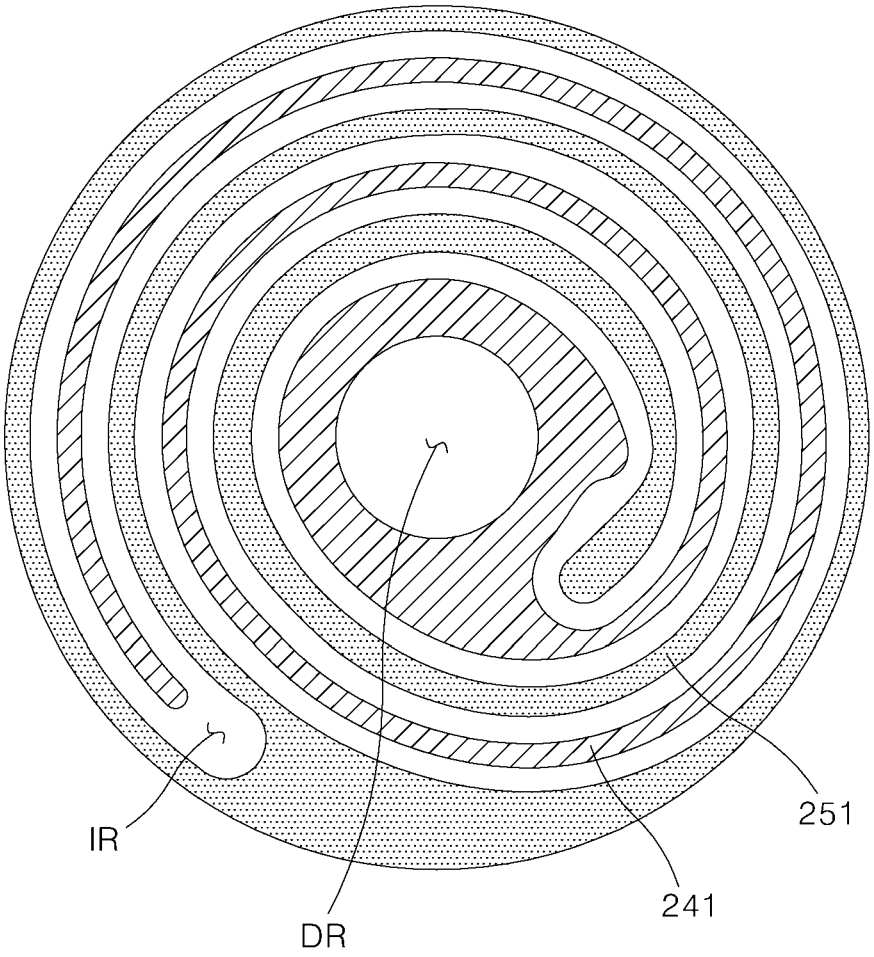
FIG. 4 is a schematic view illustrating a coupling relationship between the fixed wrap and the orbiting wrap in FIG. 3.
Figure 5:
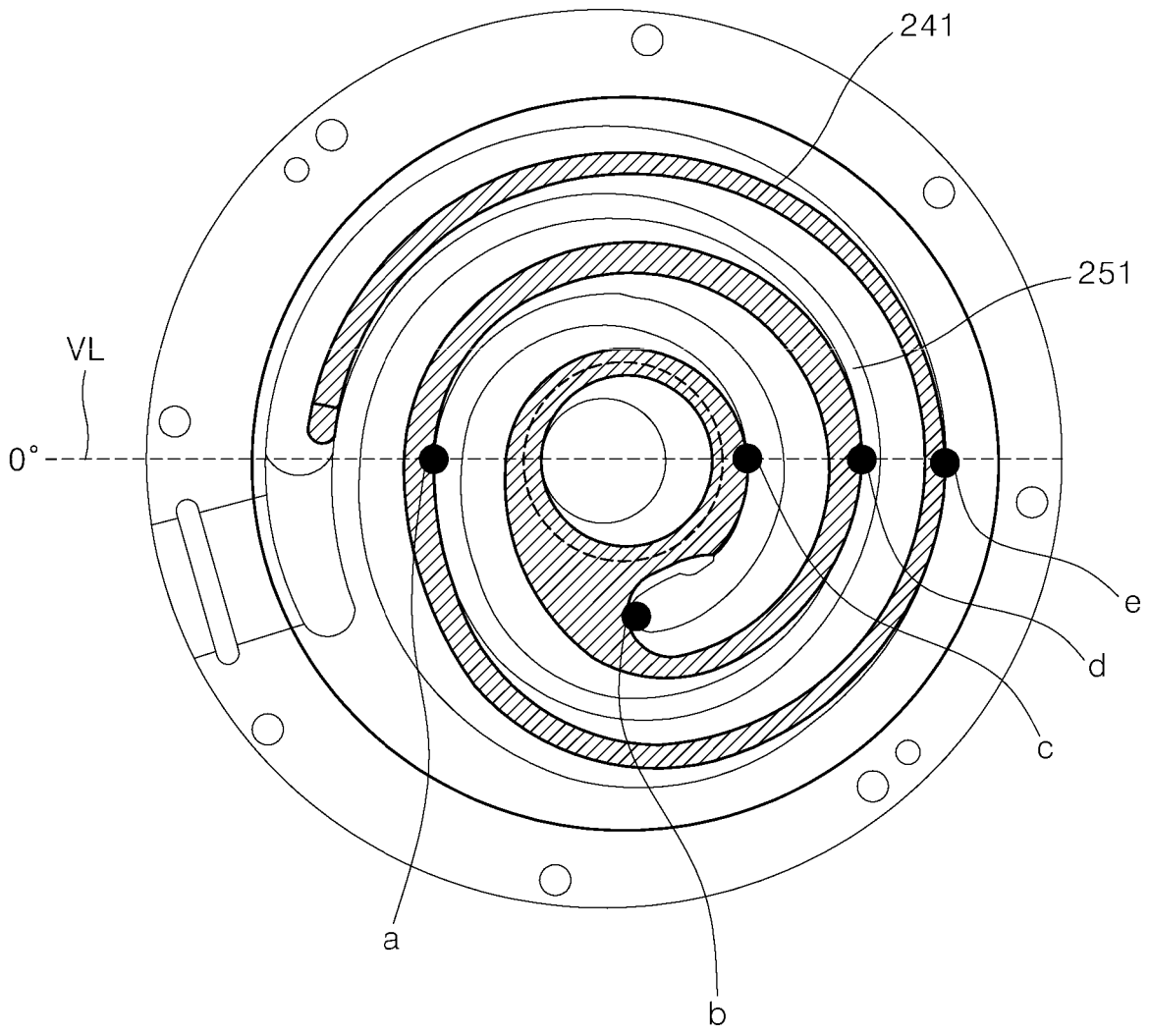
FIGS. 5 and 6 are schematic views illustrating changes in the number of points of contact between an orbiting wrap and a fixed wrap on the basis of a crank angle.
Figure 6:
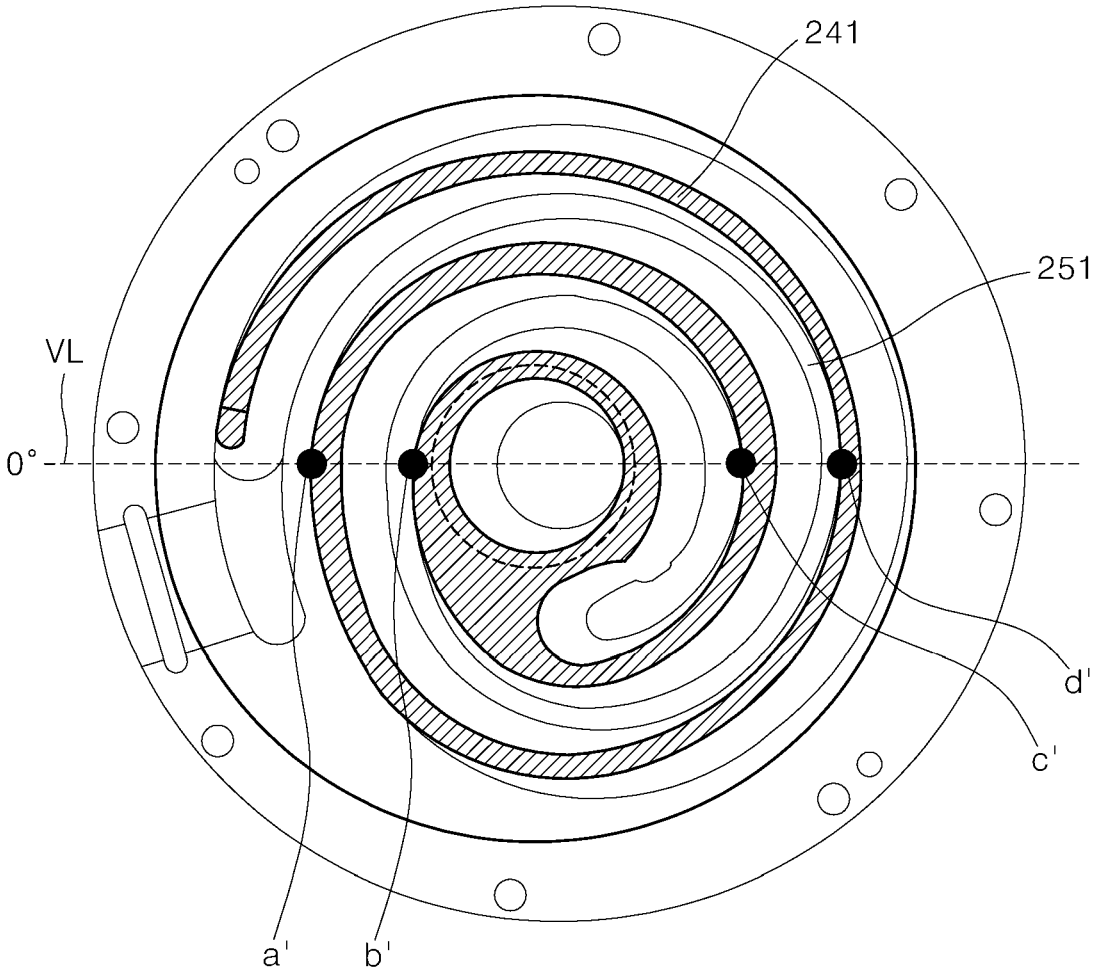
Figure 7:
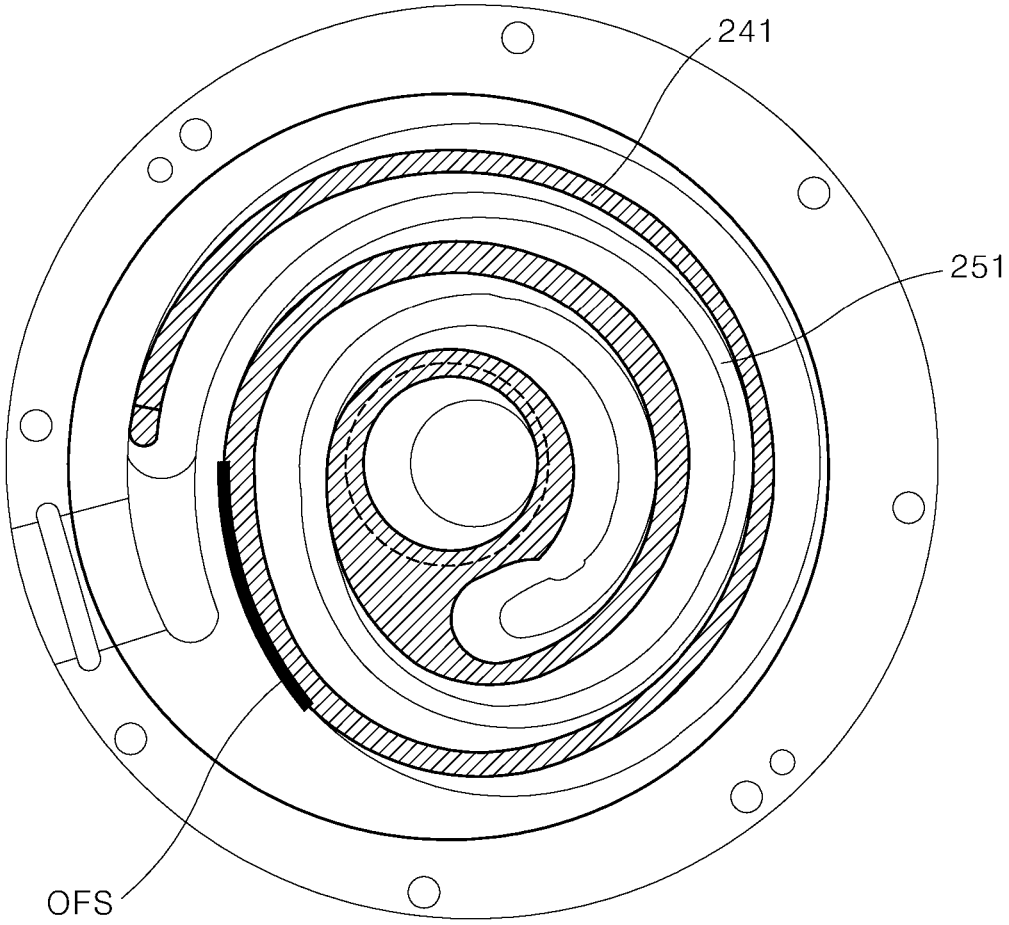
FIG. 7 is a graph illustrating an offset section that is selected based on the number of points of contact between an orbiting wrap and a fixed wrap, and a surface area of contact between the orbiting wrap and the fixed wrap.
Figure 8:
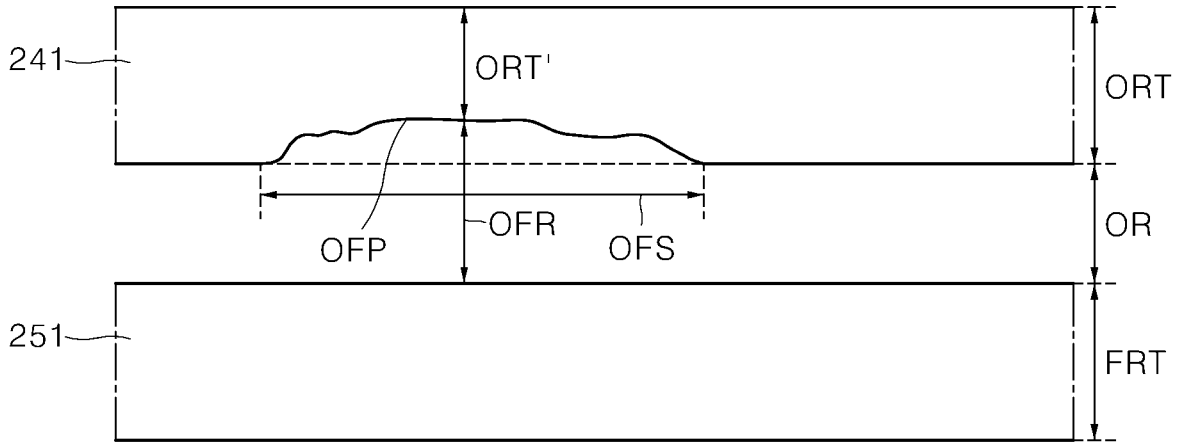
FIG. 8 is a schematic view illustrating an example offset part that is formed in the offset section in FIG. 7.
Figure 9:
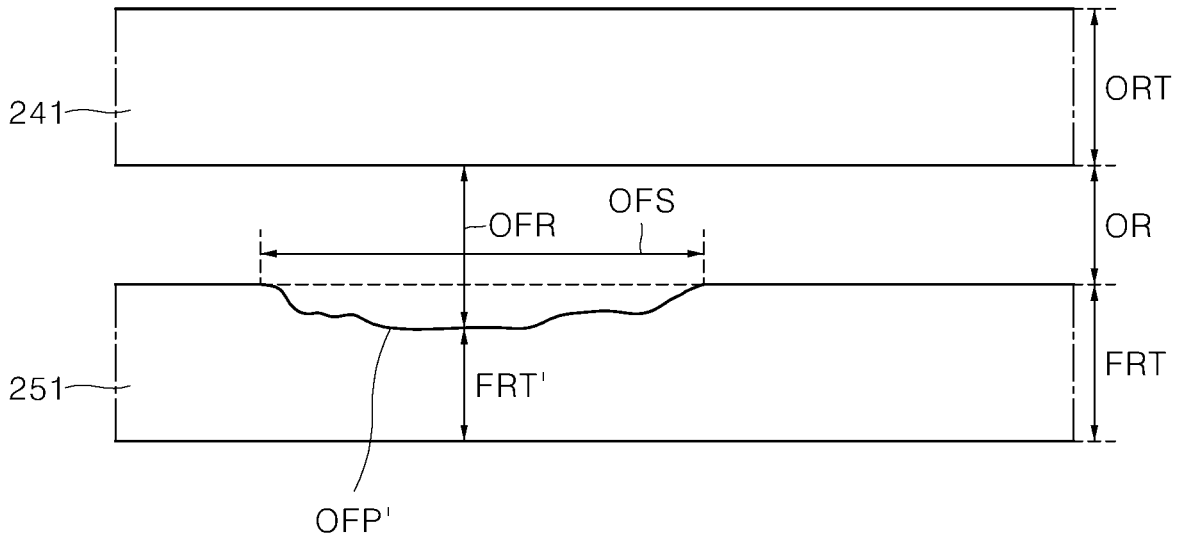
FIG. 9 is a schematic view illustrating another example offset part that is formed in the offset section in FIG. 7.
Figure 10:
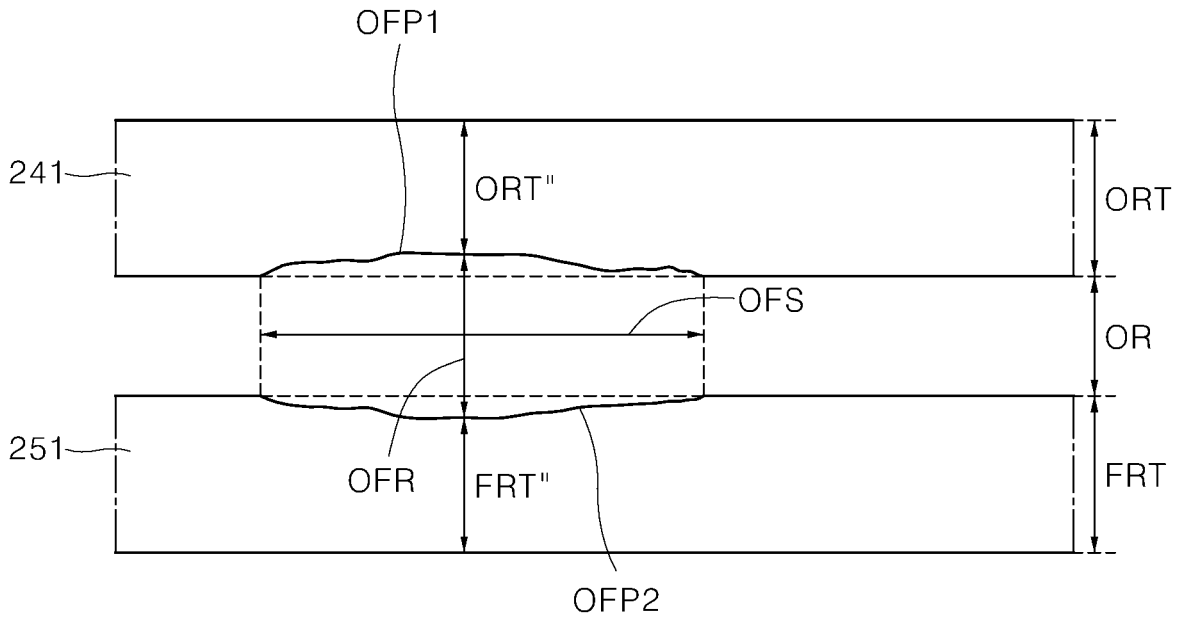
FIG. 10 is a schematic view illustrating yet another example offset part that is formed in the offset section in FIG. 7.

FIG. 4 is a schematic view illustrating a coupling relationship between the fixed wrap and the orbiting wrap in FIG. 3, FIGS. 5 and 6 are schematic views illustrating changes in the number of points of contact between an orbiting wrap and a fixed wrap on the basis of a crank angle, FIG. 7 is a graph illustrating an offset section that is selected based on the number of points of contact between an orbiting wrap and a fixed wrap, and a surface area of contact between the orbiting wrap and the fixed wrap, FIG. 8 is a schematic view illustrating an example offset part that is formed in the offset section in FIG. 7, FIG. 9 is a schematic view illustrating another example offset part that is formed in the offset section in FIG. 7, and FIG. 10 is a schematic view illustrating yet another example offset part that is formed in the offset section in FIG. 7.

FIGS. 8 to 10 are schematic views illustrating the orbiting wrap and the fixed wrap in FIG. 3 that are unfolded.

Referring to FIG. 4, the orbiting wrap 241 may be engaged with the fixed wrap 251 and may form a compression chamber that consists of an intake chamber (IR), an intermediate-pressure chamber (invisible), and a discharge chamber (DR).

Specifically, when refrigerants are suctioned through the intake chamber (IR), the suctioned refrigerants are compressed while the orbiting wrap 241 is engaged with the fixed wrap 251 and orbits, and the compressed refrigerants may be discharged through the discharge chamber (DR).

While the refrigerants are compressed, centrifugal force occurs, and the orbiting wrap 241 or the fixed wrap 215 may be deformed due to the centrifugal force. In particular, in sections in which thickness of the wrap is small and in which a surface area of contact between the orbiting wrap 241 and the fixed wrap 251 is large, the wrap may be largely deformed due to centrifugal force.

In implementations, to solve the problem, an offset section may be set based on the number of points of contact between the orbiting wrap 241 and the fixed wrap 251, and a surface area of contact between the orbiting wrap 241 and the fixed wrap 251.

Referring to FIGS. 5 and 6, distribution of centrifugal forces is described as follows based on the number of points of contact between the orbiting wrap 241 and the fixed wrap 251.

FIG. 5 shows an orbiting wrap 241 and a fixed wrap 251 when a crank angle is 170°.

The suction ending point (i.e., a suction ending point of refrigerants) may denote a point at which suction ends in the compression chamber that is formed between an inner lateral surface (i.e., a surface that faces the center of the fixed scroll 250 out of both lateral surfaces of the fixed wrap 251) of the fixed wrap 251, and an outer lateral surface (i.e., a surface opposite to a surface that faces the center of the orbiting scroll 240 out of both lateral surfaces of the orbiting wrap 241) of the orbiting wrap 241. That is, the suction ending point denotes a point in time when a suction end of the orbiting wrap 241 contacts the inner lateral surface of the fixed wrap 251, and if the point in time is 0 (zero)°, an angle at which the rotary shaft (226 in FIG. 3) rotates with respect to 0° is a crank angle. In FIG. 5, the left straight line of the virtual line (VL; a line connecting the center of the fixed scroll (250 in FIG. 3) and the suction ending point) illustrated in the drawing with respect to the center of the rotary shaft (226 in FIG. 3) may be 0°. Additionally, as the rotary shaft (226 in FIG. 3) rotates, the eccentric portion (226*f* in FIG. 3) also rotates. Thus, the crank angle may denote a rotation angle of the eccentric part.

When the crank angle is 170°, the total number of points of contact between the orbiting wrap 241 and the fixed wrap 251 is five (a, b, c, d, e), as in FIG. 5. Among the five contact points (a, b, c, d, e), four contact points (a, c, d, e) are on the virtual line (VL), and only one contact point (b) is out of the virtual line (VL).

If the total centrifugal force is 100%, for instance, centrifugal force applied to contact point "a" may be 29.1%, centrifugal force applied to contact point "b" may be 3.1%, centrifugal force applied to contact point "c" may be 13.1%, centrifugal force applied to contact point "d" may be 22.9%, and centrifugal force applied to contact point "e" may be 31.8%. This means that centrifugal force is distributed and applied not only to the four contact points (a, c, d, e) that are on the virtual line (VL) but also to one contact point (b) that is out of the virtual line (VL).

When the number of points of contact between the orbiting wrap 241 and the fixed wrap 251 is five, the crank angle may be within a range of 0° to 260°.

FIG. 6 shows an orbiting wrap 241 and a fixed wrap 251 when a crank angle is 350°.

When the crank angle is 350°, the total number of points of contact between the orbiting wrap 241 and the fixed wrap 251 is four (a', b', c', d'), as in FIG. 6. All the four contact points (a', b', c', d') are on the virtual line (VL).

If the total centrifugal force is 100%, for instance, centrifugal force applied to contact point "a'" may be 33%, centrifugal force applied to contact point "b'" may be 22.9%, centrifugal force applied to contact point "c" may be 17.7%, and centrifugal force applied to contact point "d'" may be 26.3%. This means that most of the centrifugal force is applied to the four contact points (a', b', c', d') that are on the virtual line (VL).

When the number of points of contact between the orbiting wrap 241 and the fixed wrap 251 is four, the crank angle may be within a range of 270° to 350°.

In summary, the number of points of contact between the orbiting wrap 241 and the fixed wrap 251 when the crank angle is within a range of 270° to 350° may be smaller than the number of points of contact between the orbiting wrap 241 and the fixed wrap 251 when the crank angle is out of a range of 270° to 350° (i.e., a range of 0° to 260°). Accordingly, centrifugal force distributed to each of the contact points when the crank angle is within a range of 270° to 350° may be greater than centrifugal force distributed to each of the contact points when the crank angle is within a range of 0° to 260°.

With reference to FIG. 7, a surface area of contact between the orbiting wrap 241 and the fixed wrap 251 is described as follows.

FIG. 7 shows an orbiting wrap 241 and a fixed wrap 251 when a crank angle is 350°.

When a crank angle is 350°, the number of points of contact between the orbiting wrap 241 and the fixed wrap 251 is four, as in FIG. 6. A contact point at which a surface area of contact between the orbiting wrap 241 and the fixed wrap 251 is largest, among the contact points, may be a portion (OFS) illustrated in FIG. 7.

The portion (OFS) in which a surface area of contact between the orbiting wrap 241 and the fixed wrap 251 is largest, in FIG. 7, may be a portion in which thickness of the wrap is small (i.e. an outer portion) and in which distribution ration of centrifugal force is great (i.e., 33% of centrifugal force). Thus, the portion is highly likely to be deformed and broken due to centrifugal force.

Accordingly, in the example scroll compressor 1, an offset section (herein after referred to as "offset section" or "portion in which a surface area of contact between the orbiting wrap and the fixed wrap is largest (OFS)) may be formed in the portion (OFS) in which a surface area of contact between the orbiting wrap and the fixed wrap is largest.

That is, the offset section (OFS) may be formed between the inner lateral surface of the fixed wrap 251 and the outer lateral surface of the orbiting wrap 241, and the section in which the offset section (OFS) is formed may be a section in which a surface area of contact between the fixed wrap 251 and the orbiting wrap 241 is largest when a crank angle is within a pre-set range of angles (a range of 270° to 350°) with respect to a portion that is most vulnerable to centrifugal force (i.e., suction ending point) (0°)).

The pre-set range of angles may be set based on the number of points of contact between the fixed wrap 251 and the orbiting wrap 241, and as a result, a range of 270° to 350° with a smaller number of contact points may be determined as a pre-set range of angles.

A crank angle within a pre-set range of angles may mean the number of points of contact between the fixed wrap 251 and the orbiting wrap 241 is a pre-set number or less (e.g., four contact points).

That is, when a crank angle is within a pre-set range of angles (a range of 270° to 350°), the number of points of contact between the fixed wrap 251 and the orbiting wrap 241 may be four (i.e., a pre-set number or less) while when a crank angle is out of a pre-set range of angles (a range of 0° to 260°), the number of points of contact between the fixed wrap 251 and the orbiting wrap 241 may be five (i.e., greater than a pre-set number).

In the offset section (OFS), an offset part may be formed on at least one of the inner lateral surface of the fixed wrap 251 and the outer lateral surface of the orbiting wrap 241. The offset part has a distance between the wraps greater than an orbital radius.

Below, the offset part is described with reference to FIGS. 8 to 10.

Referring to FIG. 8, the offset part (OFP) may be formed on the outer lateral surface of the orbiting wrap 241, which is an offset section (OFS).

Specifically, an offset part (OFP) may be formed on the outer lateral surface of the orbiting wrap 241 in a direction in which the orbiting wrap 241 is wound, and wrap thickness of the orbiting wrap 241 may be reduced (i.e., from ORT to ORT') by the offset part (OFP). Additionally, a gap between the inner lateral surface of the fixed wrap 251 and the outer lateral surface of the orbiting wrap 241 may increase (i.e., from OR to OFR) by the offset part (OFP). That is, wrap thickness in the offset section (OFS) is less than wrap thickness outside the offset section (OFS).

Thus, the offset part (OFP) may prevent contact between the fixed wrap 251 and the orbiting wrap 241 in the offset section (OFS). A surface area of contact between the fixed wrap 251 and the orbiting wrap 241 may become smaller in a section that is most vulnerable to centrifugal force (i.e., offset section (OFS)). As a result, centrifugal force is prevented from concentrating on the section that is most vulnerable to centrifugal force (i.e., offset section (OFS)). By doing so, deformation or damage done to the wraps by centrifugal force may be minimized.

A processed amount of the offset part (OFP) (i.e., thickness of a removed wrap), for instance, may be greater than 0 μm and less than 20 μm but may not be restricted. Referring to FIG. 9, the offset part (OFP) may also be formed on the inner lateral surface of the fixed wrap 251, which is an offset section (OFS).

Specifically, an offset part (OFP') may be formed on the inner lateral surface of the fixed wrap 251 in a direction in which the fixed wrap 251 is wound, and wrap thickness of the fixed wrap 251 may be reduced (i.e., from FRT to FRT') by the offset part (OFP'). Additionally, a gap between the inner lateral surface of the fixed wrap 251 and the outer lateral surface of the orbiting wrap 241 may increase (i.e., from OR to OFR) by the offset part (OFP').

Referring to FIG. 10, the offset part (OFP1, OFP2) may also be formed on both of the outer lateral surface of the orbiting wrap 241 and the inner lateral surface of the fixed wrap 251, which are an offset section (OFS).

Specifically, a first offset part (OFP1) may be formed on the outer lateral surface of the orbiting wrap 241 in a direction in which the orbiting wrap 241 is wound, and a second offset part (OFP2) may be formed on the inner lateral surface of the fixed wrap 251 in a direction in which the fixed wrap 251 is wound. Wrap thickness of the orbiting wrap 241 may be reduced (i.e., from ORT to ORT") by the first offset part (OFP), and wrap thickness of the fixed wrap 251 may be reduced (i.e., from FRT to FRT") by the second offset part (OFP). Additionally, a gap between the inner lateral surface of the fixed wrap 251 and the outer lateral surface of the orbiting wrap 241 may increase (i.e., from OR to OFR) by the first offset part (OFP1) and the second offset part (OFP2).

The shape of the offset part in FIGS. 8 to 10 is presented only as an example and may vary in the offset section (OFS).

As described above, a scroll compressor 1 according to the present disclosure may minimize deformation or damage done to wraps by centrifugal force, thereby making it possible to improve efficiency and credibility of the scroll compressor.

According to the scroll compressor 1, a section (i.e., an offset section (OFS)) of wraps, which is most vulnerable to deformation or damage caused by centrifugal force is selected based on the number of points of contact between an orbiting wrap 241 and a fixed wrap 251 and surface areas of contact between the orbiting wrap 241 and the fixed wrap 251, and an offset part is formed only in the section, thereby making it possible to improve efficiency of offset processing. That is, the offset part is not formed in sections that are not in priority, thereby making it possible to prevent an increase in manufacturing time due to offset processing.

The present disclosure that is described above may be replaced, changed and modified in different ways by one having ordinary skill in the art to which the disclosure pertains without departing from the technical spirit of the disclosure. Thus, the disclosure should not be construed as being limited to the implementations and the attached drawings set forth herein.

What is claimed is:

1. A scroll compressor, comprising:

a casing that defines an oil storage space at a lower portion of the casing, the oil storage space being configured to receive oil;

a drive motor disposed in an inner space of the casing;

a rotary shaft coupled to the drive motor and configured to be rotated by the drive motor;

a main frame disposed at a lower portion of the drive motor;

a fixed scroll disposed at a lower portion of the main frame, the fixed scroll comprising a fixed wrap that is arranged about a center of the fixed scroll; and an orbiting scroll that is disposed between the main frame and the fixed scroll, that receives the rotary shaft, and to which the rotary shaft is eccentrically coupled, the orbiting scroll comprising an orbiting wrap that is arranged about a center of the orbiting scroll, that is configured to engage with the fixed wrap, and that defines a compression chamber comprising an intake chamber, an intermediate-pressure chamber, and a discharge chamber, wherein at least one of the fixed wrap or the orbiting wrap defines an offset section between a lateral surface of the fixed wrap and a lateral surface of the orbiting wrap that faces the lateral surface of the fixed wrap, the offset section comprising an offset gap that is defined between the lateral surface of the fixed wrap and the lateral surface of the orbiting wrap, the offset gap being greater than an orbital radius that corresponds to a distance between the fixed wrap and the orbiting wrap in a state in which the center of the fixed scroll is aligned to the center of the orbiting scroll, wherein the offset section is disposed at a contact portion that is defined between the fixed wrap and the orbiting wrap based on rotation of the orbiting scroll relative to the fixed scroll, the contact portion having a maximum length based on a rotation angle of the rotary shaft being within a pre-set range with respect to a reference point, wherein the fixed wrap and the orbiting wrap are configured to contact each other at a plurality of contact points defined based on the rotation angle of the rotary shaft, and wherein a number of the contact points defined based on the rotation angle of the rotary shaft being within the pre-set range is less than a number of the contact points defined based on the rotation angle of the rotary shaft being out of the pre-set range.

2. The scroll compressor of claim 1, wherein the pre-set range comprises a range from 270° to 350° with respect to the reference point.

3. The scroll compressor of claim 1, wherein the offset section is defined between an inner lateral surface of the fixed wrap and an outer lateral surface of the orbiting wrap.

4. The scroll compressor of claim 3, wherein the offset section comprises an offset part that is recessed from at least one of the inner lateral surface of the fixed wrap or the outer lateral surface of the orbiting wrap, the offset part increasing a distance between the inner lateral surface of the fixed wrap and the outer lateral surface of the orbiting wrap.

5. The scroll compressor of claim 4, wherein a recessed depth of the offset part is greater than 0 μm and less than 20 μm from the at least one of the inner lateral surface of the fixed wrap or the outer lateral surface of the orbiting wrap.

6. The scroll compressor of claim 4, wherein the offset part is defined at the inner lateral surface of the fixed wrap, and extends in a direction in which the fixed wrap is arranged about the center of the fixed scroll, the offset part decreasing a wrap thickness of the fixed wrap.

7. The scroll compressor of claim 4, wherein the offset part is defined at the outer lateral surface of the orbiting wrap, and extends in a direction in which the orbiting wrap is arranged the center of the orbiting scroll, the offset part decreasing a wrap thickness of the orbiting wrap.

8. The scroll compressor of claim 3, wherein the fixed scroll comprises a first lateral surface that faces toward the center of the fixed scroll and a second lateral surface that faces opposite of the first lateral surface of the fixed scroll, the inner lateral surface of the fixed wrap corresponding to the first lateral surface of the fixed scroll, and wherein the orbiting scroll comprises a first lateral surface that faces toward the center of the orbiting scroll and a second lateral surface that faces opposite of the first lateral surface of the orbiting scroll, the outer lateral surface of the orbiting wrap corresponding to the second lateral surface of the orbiting scroll.

9. The scroll compressor of claim 1, wherein a wrap thickness of at least one of the fixed wrap or the orbiting wrap in the offset section is less than a wrap thickness of at least one of the fixed wrap or the orbiting wrap outside of the offset section.

10. The scroll compressor of claim 1, wherein the number of the contact points varies based on the rotation angle of the rotary shaft.

11. The scroll compressor of claim 1, wherein the orbiting scroll further comprises:

a rotary shaft coupler that receives the rotary shaft and eccentrically couples the rotary shaft to the orbiting scroll, and an orbiting scroll end plate, the orbiting wrap protruding from a lower surface of the orbiting scroll end plate, wherein the main frame comprises:

a frame end plate comprising a frame bearing section disposed at a center region of the frame end plate, the rotary shaft passing through the frame end plate, and a frame side wall that protrudes downward from an outer circumference of the frame end plate, and wherein the fixed scroll comprises:

a fixed scroll end plate, the fixed wrap protruding from an upper surface of the fixed scroll end plate, and a fixed scroll side wall that protrudes upward from an outer circumference of the fixed scroll end plate.

12. A scroll compressor, comprising:

a fixed scroll comprising a fixed wrap that is arranged about a center of the fixed scroll; and an orbiting scroll comprising an orbiting wrap that is arranged about a center of the orbiting scroll, that is configured to engage with the fixed wrap, and that defines a compression chamber together with the fixed wrap, wherein at least one of the fixed wrap or the orbiting wrap defines an offset section between an inner lateral surface of the fixed wrap and an outer lateral surface of the orbiting wrap, the offset section comprising an offset gap that is defined between the inner lateral surface of the fixed wrap and the outer lateral surface of the orbiting wrap, the offset gap being greater than an orbital radius that corresponds to a distance between the fixed wrap and the orbiting wrap in a state in which the center of the fixed scroll is aligned to the center of the orbiting scroll, wherein the fixed wrap and the orbiting wrap are configured to contact each other at a plurality of contact points based on rotation of the orbiting scroll relative to the fixed scroll, and a number of the contact points varies based on rotation of the orbiting scroll relative to the fixed scroll, and wherein the offset section is disposed at a contact portion that is defined between the fixed wrap and the orbiting wrap based on rotation of the orbiting scroll relative to the fixed scroll, the contact portion having a maximum length based on the number of the contact points being less than or equal to a pre-set number.

13. The scroll compressor of claim 12, wherein the number of the contact points is less than or equal to the pre-set number based on a rotation angle of the orbiting scroll being within a range from 270° to 350° with respect to a reference point.

14. The scroll compressor of claim 12, wherein the pre-set number is four.

15. A scroll compressor, comprising:

a fixed scroll comprising a fixed wrap that is arranged about a center of the fixed scroll;

an orbiting scroll comprising an orbiting wrap that is arranged about a center of the orbiting scroll, that is configured to engage with the fixed wrap, that defines a compression chamber together with the fixed wrap; and an offset part that is defined at at least one of an inner lateral surface of the fixed wrap or an outer lateral surface of the orbiting wrap, wherein a distance between the fixed wrap and the orbiting wrap at the offset part is greater than an orbital radius corresponding to a distance between the fixed wrap and the orbiting wrap in a state in which the center of the fixed scroll is aligned to the center of the orbiting scroll, wherein the offset part is defined at a contact portion that is formed between the fixed wrap and the orbiting wrap based on rotation of the orbiting scroll relative to the fixed scroll, the contact portion having a maximum length based on a rotation angle of the orbiting scroll being within a pre-set range with respect to a reference point, wherein the fixed wrap and the orbiting wrap are configured to contact each other at a plurality of contact points defined based on the rotation angle of the orbiting scroll, and wherein a number of the contact points defined based on the rotation angle of the orbiting scroll being within the pre-set range is less than a number of the contact points defined based on the rotation angle of the orbiting scroll being out of the pre-set range.

16. The scroll compressor of claim 15, wherein the pre-set range comprises a range from 270° to 350°.

17. The scroll compressor of claim 15, wherein the offset part is recessed from the at least one of the inner lateral surface of the fixed wrap or the outer lateral surface of the orbiting wrap.

18. The scroll compressor of claim 17, wherein a recessed depth of the offset part is greater than 0 μm and less than 20 μm from the at least one of the inner lateral surface of the fixed wrap or the outer lateral surface of the orbiting wrap.

19. The scroll compressor of claim 15, wherein the offset part is defined at the inner lateral surface of the fixed wrap, and extends in a direction away from the center of the fixed scroll, the offset part decreasing a wrap thickness of the fixed wrap.

20. The scroll compressor of claim 15, wherein the offset part is defined at the outer lateral surface of the orbiting wrap, and extends in a direction toward the center of the orbiting scroll, the offset part decreasing a wrap thickness of the orbiting wrap.

* * * * *